United States Patent [19]

Lundberg et al.

[11] Patent Number: 4,751,011

[45] Date of Patent: Jun. 14, 1988

[54] HYDROCARBON SOLUBLE COMPLEXES BASED ON METAL SALTS OF POLYOLEFINIC DICARBOXYLIC ACIDS

[75] Inventors: Robert D. Lundberg, Bridgewater; Alan A. Schetelich, Scotch Plains; Antonio Gutierrez, Mercerville; Robert R. Phillips, Spring Lake Hgts., all of N.J.

[73] Assignee: Exxon Chemical Patents Inc., Linden, N.J.

[21] Appl. No.: 941,095

[22] Filed: Dec. 12, 1986

[51] Int. Cl.[4] ..... C10M 123/00

[52] U.S. Cl. ..... 252/35; 252/51.5 A; 252/56 D

[58] Field of Search ..... 252/56 D, 51.5 A, 35

[56] References Cited

U.S. PATENT DOCUMENTS

| | | | |
|---|---|---|---|
| 3,271,310 | 9/1966 | LeSuer | 252/35 |
| 3,346,493 | 10/1967 | LeSuer | 252/32.5 |
| 3,509,052 | 4/1970 | Murphy | 252/56 D |
| 3,522,179 | 7/1970 | LeSuer | 252/51.5 |
| 3,632,510 | 1/1972 | LeSuer | 252/36 |
| 3,714,042 | 1/1973 | Greenough | 252/33.2 |
| 4,234,435 | 11/1980 | Meinhardt et al. | 252/51.5 |
| 4,292,186 | 9/1981 | Chibnik et al. | 252/49.7 |
| 4,552,677 | 11/1985 | Hopkins | 252/33.6 |
| 4,557,847 | 12/1985 | Gutierrez et al. | 252/56 D |
| 4,558,170 | 12/1985 | Chen et al. | 585/532 |
| 4,632,769 | 12/1986 | Gutierrez et al. | 252/56 D |

FOREIGN PATENT DOCUMENTS 0024146 9/1985 European Pat. Off. .

*Primary Examiner*—Jacqueline V. Howard

*Attorney, Agent, or Firm*—E. T. Wheelock; J. B. Murray, Jr.

[57] ABSTRACT

This invention relates to oil soluble additives particularly useful in lubricating oil compositions, and to concentrates or lubricating compositions containing these additives. The additives are various metal salts of mono- or dicarboxylic acids, anhydrides, esters, etc., which have been substituted with a high molecular weight hydrocarbon group, and derivatives thereof. The high molecular weight hydrocarbon group has a number average-molecular weight ($M_n$) of greater than about 900. The metal salt additives are especially useful in combination with certain grafted ethylene-olefin copolymers or copolymers of 4-vinyl pyridine and esters of aliphatic mono-, di- or polycarboxylic acids as viscosifying agents.

34 Claims, No Drawings

HYDROCARBON SOLUBLE COMPLEXES BASED ON METAL SALTS OF POLYOLEFINIC DICARBOXYLIC ACIDS

FIELD OF THE INVENTION

This invention relates to oil soluble additives particularly useful in lubricating oil compositions, and to concentrates or lubricating compositions containing these additives. The additives are various salts of dicarboxylic acids which have been substituted with a high molecular weight hydrocarbon group, and derivatives thereof. The high molecular weight hydrocarbon group preferably has a number average-molecular weight ($M_n$) of greater than about 900. The additives are useful in combination with certain grafted ethylene-olefin copolymers or copolymers of 4-vinyl pyridine and esters of aliphatic mono-, di-, or polycarboxylic acids and are particularly useful as viscosifying agents.

BACKGROUND OF THE INVENTION

Metal salts of alkenyl succinic acids are known. For instance, U.S. Pat. No. 3,271,310 teaches that a "metal salt of hydrocarbon-substituted succinic acid having at least 50 aliphatic carbon atoms in the hydrocarbon substituent, the metal of the metal salt being selected from the class consisting of Group I metals, Group II metals, aluminum, lead, tin, cobalt and nickel" is useful as a dual purpose (detergent/rust inhibitor) additive.

Similarly, U.S. Pat. No. 4,552,677 discloses a similar material in which the preferred metal in the salt is copper and the hydrocarbon substituent contains from 8 to 35 carbon atoms.

U.S. Pat. No. 4,234,435 discloses that certain of the salts disclosed in U.S. Pat. No. 3,271,310 are useful as dispersant/detergents and viscosity index improvers. The salts contain an acylating agent derived from polyalkenes, such as polybutenes, and a dibasic, carboxylic reactant such as maleic or fumaric acid. The acylating agents are specifically characterized in that the polyalkenes from which they are derived include those in which the polybutene moiety has a $M_n$ of from about 1,300 to about 5,000, a $M_w/M_n$ ratio of between about 1.5 and 4.0, and in which the ratio of the succinic acid moiety to the polybutene substituent is at least 1.3.

U.S. Pat. No. 3,714,042 relates to the treatment of basic metal sulfonate complexes, sulfonate-carboxylate complexes and carboxylate complexes with high molecular weight carboxylic acids to prepare additives useful in lubricating oils and gasolines. The patentee teaches the ineffectiveness of preformed metal salts of high molecular weight carboxylic acids for such treatments, and exemplifies the sediment formation resulting from use of the calcium salt of polyisobutenyl succinic anhydride at low concentrations in a mineral lubricating oil.

SUMMARY OF THE INVENTION

The present invention is directed to compositions containing (a) an additive comprising metal salts of the product of a polyolefin of at least 900 number average molecular weight ($M_n$) substituted with dicarboxylic acid producing moieties (preferably acid or anhydride moieties), and (b) another interactive viscosity modifying polymer, typically a copolymer, having a low level of contained nitrogen as free amine. The two polymers interact apparently to form a complex which gives controllable but effective viscosification. Especially effective salts are the Cu and Zn salts although the effect is also found with other metal salts. The preferred interactive polymers are either ethylene-propylene copolymers which have been grafted with a polyolefinic dicarboxylic acid material and a polyamine or copolymers of 4-vinyl pyridine and alkyl methacrylate.

DESCRIPTION OF THE PREFERRED EMBODIMENTS

Lubricating oil compositions, e.g., oils suitable for gasoline and diesel engines, etc., can be prepared using the compositions of this invention. Universal type crankcase oils, those in which the same lubricating oil composition is used for either gasoline or diesel engines, may also be prepared. These lubricating oil formulations conventionally contain several different types of additives that will supply the characteristics that are required for the particular use. Among these types of additives are included viscosity index improvers, antioxidants, corrosion inhibitors, detergents, dispersants, pour point depressants, antiwear agents, etc.

In the preparation of lubricating oil formulations, it is common practice to introduce many of the additives in the form of a concentrate (for instance, as an "ad pack") containing 10 to 80 weight percent, e.g., 20 to 80 weight percent, active ingredient in a solvent. The solvent may be a hydrocarbon oil, e.g., a mineral lubricating oil, or other suitable material. In forming finished lubricants, such as crankcase motor oils, these concentrates, in turn, may be diluted with 3 to 100, preferably 5 to 40, parts by weight of lubricating oil per part by weight of the additive package. One uses concentrates, of course, to make the handling of the various constituent materials less difficult as well as to facilitate solution in or dispersion of those materials in the final blend. Typically, however the viscosifying agents are added separately because of their excessive viscosity and concomitant mixing difficulties. Viscosifier concentrates often contain a major amount of a solvent.

The subject matter of this invention is a combination of materials which act together as viscosity modifiers or viscosity index improvers. Viscosity index improvement is the ability of polymeric additives to provide to lubricating formulations, at both low and high temperatures, substantial viscosity sufficient to maintain lubricating films on the surfaces of moving parts in an engine.

THE COMPOSITIONS

Compositions made according to this invention generally will contain at least two components in the mixtures. They will contain as the first component, an interactive viscosifier comprising the metal salt of a high molecular weight alkenyl substituted succinic acid. The second component will be either (a) an ethylene-propylene copolymer which has been grafted with a polyolefinic dicarboxylic acid material and a polyamine or (b) a copolymer of 4-vinyl pyridine and alkyl methacylate. Although the second component has moderate viscosification capabilities of its own, the interaction between the two components is significant and forms the basis of this invention. Depending upon the use to which the compositions are ultimately placed, the compositions may also include detergents, dispersants, antiwear agents, antioxidants, friction modifiers, pour point depressants, and the like. Indeed, the inventive composition may consist essentially of the metal salt of the alkenyl substituted succinic acid and the second viscosification component.

When the compositions of the invention are used in the form of lubricating oil compositions, such as automotive crankcase lubricating oil compositions, a major amount of a lubricant may be included in the composition. Broadly, the composition may contain about 85 to about 99.99 weight percent of a lubricant. Preferably, about 93 to about 99.8 weight percent of the lubricant. The term "lubricating oil" is intended to include not only hydrocarbon oils derived from petroleum but also synthetic oils such as alkyl esters of dicarboxylic acids, polyglycols and alcohols, polyalphaolefins, alkyl benzenes, organic esters of phosphoric acids, polysilicone oils, etc.

When the compositions of this invention are provided in the form of concentrates, with or without the other noted additives, a substantial amount, e.g., up to about 95 percent by weight, of a solvent, mineral or synthetic oil may be included to enhance the handling properties of the concentrate.

THE FIRST VISCOSIFICATION AGENT

The first component of the viscosification material preferred in this inventive composition are metal salts of a long chain hydrocarbyl substituted mono- or dicarboxylic acid material, i.e., acid, anhydride, or ester, and includes a long chain hydrocarbon, generally a polyolefin, substituted with alpha or beta unsaturated $C_4$ to $C_{10}$ mono- or dicarboxylic acids, itaconic acid, maleic acid, maleic anhydride, chloromaleic acid, dimethyl fumarate, chloromaleic anhydride, acrylic acid, methacrylic acid, crotonic acid, cinnamic acid, etc.

The ratio of dicarboxylic acid units per olefin molecule may be as low as 1.0. Excellent viscosification effects have been seen with ratios of 1.2 to 1.4. Ratios of up to about 2.0 may also be employed.

Preferred olefin polymers for the reaction with the unsaturated dicarboxylic acids are those polymers made up of a major amount of $C_2$ to $C_{10}$, e.g., $C_2$ to $C_5$, monoolefin. Such olefins include ethylene, propylene, butylene, isobutylene, pentene, octene-1, styrene, etc. The polymers may be homopolymers such as polyisobutylene or copolymers of two or more of such olefins. These include copolymers of: ethylene and propylene; butylene and isobutylene; propylene and isobutylene; etc. Other copolymers include those in which a minor molar amount of the copolymer monomers, e.g., 1 to 10 mole percent is a $C_4$ to $C_{18}$ diolefin, e.g., copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have number average molecular weights above about 900. Particularly useful olefin polymers have number average molecular weights within the range of about 1,200 and about 3,000 with approximately one double bond per polymer chain. An especially suitable starting material for this additive is polyisobutylene. The number average molecular weight for such polymers can be determined by several known techniques. A convenient method for such determination is by gel permeation chromatography (GPC) which additionally provides molecular weight distribution information, see W. W. Yua, J. J. Kirkland and D. D. Bly, "Modern Size Exclusion Liquid Chromatography," John Wiley and Sons, New York, 1979.

Processes for reacting the olefin polymer with the $C_{4-10}$ unsaturated mono- or dicarboxylic acid, anhydride or ester are known in the art. For example, the olefin polymer and the dicarboxylic acid material may be simply heated together as disclosed in U.S. Pat. Nos. 3,361,673 and 3.401,118 to cause a thermal "ene" reaction to take place. Or, the olefin polymer can be first halogenated, for example, chlorinated or brominated to about 1 to 8, preferably 3 to 7 weight percent chlorine, or bromine, based on the weight of polymer, by passing the chlorine or bromine through the polyolefin at at temperature of 100° to 250°, e.g., 140° to 225° C., for about 0.5 to 10, preferably 1 to 7 hours. The halogenated polymer may then be reacted with sufficient unsaturated acid or anhydride at 100° to 250°, usually about 140° to 180° C. for about 0.5 to 10, e.g., 3 to 8 hours. Processes of this general type are taught in U.S. Pat. Nos. 3,087,436; 3,172,892; 3,272,746; and others.

Alternatively, the olefin polymer, and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. Pat. No. 1,440,219.

By the use of halogen, about 65 to 95 weight percent of the polyolefin will normally react with the dicarboxylic acid material. Thermal reactions, those carried out without the use of halogen or a catalyst, cause only about 50 to 75 weight percent of the polyisobutylene to react. Chlorination obviously helps to increase the reactivity.

The salts of the polyalkenyl substituted dicarboxylic acids, may then be produced by a reaction with a suitable metal containing material. Metals include those selected from Groups I, II, or mixtures (e.g., Li, Na, K, Rb, Cs, Mg, Ca, Sr, Ba, Cu, Cd, Zn), more preferably metals of Groups IB, IIB or IIIB, or mixtures thereof. Although the viscosification effect is observed with alkaline earth metals, the effect is especially pronounced with the preferred metals of Zn and Cu. Especially preferred is Cu.

Examples of the metal salts of this invention are Cu and Zn salts of polyisobutenyl succinic anhydride (hereinafter referred to as Cu-PIBSA and Zn-PIBSA, respectively), and Cu and Zn salts of polyisobutenyl succinic acid. Preferably, the selected metal employed is its divalent form, e.g., $Cu^{+2}$.

The method used to produce the metal salt is not believed to be critical to the invention. However, one suitable method of producing the desired salt is via the following procedure: the polyalkenyl substituted dicarboxylic acid is first dissolved in a suitable mineral oil solvent. A metal acetate is introduced into the mineral oil mixture along with a moderate amount of water. The resulting blend may then be heat-soaked at a moderate temperature, e.g., between 95° and 150° C., for a period of time sufficient to complete the reaction. Reaction times vary widely depending upon such things as feedstocks, concentration, etc., but reaction times in the region of one to four hours have been found to be suitable. The product may, if needed or desired, be stripped using an inert gas and then filtered.

The metal salts (e.g., Cu-PIBSA, Zn-PIBSA, or mixtures thereof) will be generally employed in amounts of from about 0.1 to 20 wt. %, and preferably from about 0.2 to 15 wt. % in the final lubricating or fuel composition.

THE SECOND VISCOSIFICATION AGENT

In general, high molecular weight (e.g., $M_n = 10{,}000$ to 500,000) polymers having but a minor amount of free amine sites are adequate to form polymer-polymer complexes with the first viscosification agent.

However, the preferred materials are either (a) ethylene-olefin copolymers which have been grafted with a polyolefinic dicarboxylic acid material and a polyamine and a carboxylic acid or (b) copolymers of 4-vinyl pyridine and monomers whose homopolymers are hydrocarbon soluble, such as the alkyl methacrylates.

Ethylene-Olefin Polymers

The desired materials of this class and a method of producing them are thoroughly described in U.S. Pat. No. 4,137,185, to Gardiner et al., the entirety of which is specifically incorporated by reference.

The materials may be described as having an ethylene-olefin backbone, optionally including a diolefin. The ethylene is present in the polymer backbone in a amount between 2 and 98 weight percent. The olefin, one or more of $C_3$–$C_{28}$, preferably $C_3$ to $C_{18}$ alpha olefins and most preferably propylene, is also present in a complementary amount between 2 and 98 weight percent. The copolymers preferably have a degree of crystallinity of less than 2.5 weight percent and a $M_n$ in the range of 700 to 500,000, preferably 10,000 to 250,000. Terpolymers of ethylene, the alpha olefin and a diolefin are also encompassed. The diolefin maybe, if present, found in an amount ranging up to about 20 mole percent. Representative diolefins include cyclopentadiene, 2-methyl-5-norborene, non-conjugated hexadiene or other alicyclic or aliphatic non-conjugated diolefin having from 6 to 15 carbon atoms per molecule. Ethylene-propylene copolymers are preferred.

The ethylene copolymer backbone is grafted with an ethylenically unsaturated carboxylic acid material containing at least one, preferably two, carboxylic acid or anhydride groups or a functional group which is convertible into said carboxylic groups by oxidation or hydrolysis. Maleic anhydride or a derivative thereof is preferred since it does not homopolymerize appreciably but grafts onto the ethylene copolymer or terpolymer to give two carboxylic acid functions. The preferred materials have the generic formula:

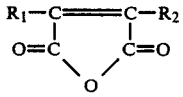

where $R_1$ and $R_2$ are hydrogen or a halogen. Representative examples include chloromaleic anhydride, itatonic anhydride, or the corresponding dicarboxylic acids, such as maleic acid, fumaric acid or their monoesters.

The free-radical induced grafting of ethylenically unsaturated carboxylic acid materials in solvents is known (see U.S. Pat. No. 3,236,917) and need not be discussed in detail here. The procedures for grafting these carboxylic acid materials typically graft them onto everything in the reaction mixture, including any solvent oil, and consequently it is difficult to predict just how much will end up with the ethylene-olefin backbone. Most will graft onto the backbone because of its greater reactivity.

The thus-grafted ethylenically unsaturated carboxylic acid ethylene-olefin copolymer may than be reacted with an amine.

The amine component (hereafter designated poly-amines) will have at least two or more amino groups. One amino group reacts with the dicarboxylic acid moiety to form an imido linkage.

Useful poly-amines include polyamines of about 2 to 60, e.g., 3 to 20, total carbon atoms and about 2 to 12, e.g., 2 to 8 nitrogen atoms in the molecule. These amines may be hydrocarbyl amines or may be hydrocarbyl amines including other groups, e.g., cyano groups, amide groups, nitriles, imidazoline groups, and the like. Hydroxy amines with 1 to 6 hydroxy groups, preferably 1 to 3 hydroxy groups are particularly useful. Preferred amines are aliphatic saturated poly-amines, including those of the general formulas:

$$RR'N\left[CH_2\right]_s\left[NH(CH_2)_s\right]_t NR'R$$

wherein R and R′ are independently selected from the group consisting of hydrogen; amino alkylene radicals, $C_2$ to $C_{12}$ alkylamino, $C_2$ to $C_6$ alkylene radicals; each s can be the same or a different number of from 2 to 6, preferably 2 to 4; and t is a number of from 0 to 10, preferably 2 to 7. At least one of R or R′ must be a hydrogen.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di-(1,3-propylene)-triamine; N,N-dimethyl-1, -3-diaminopropane; and N,N-di- (2-amino-ethyl) ethylene diamine.

Other useful amine compounds include: alicyclic diamines such as 1,4-di(aminomethyl) cyclohexane, and heterocyclic nitrogen compounds such as imidazolines, N-propyl amino morpholines such as:

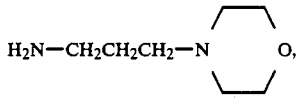

and N-aminoalkyl piperazines of the general formula:

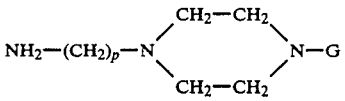

wherein G is independently selected from the group consisting of hydrogen and omega-aminoalkylene radicals of from 1 to 3 carbon atoms, and p is an integer of from 1 to 4.

Again, the multifunctionalization or imidization process is well known and need not be discussed in detail here.

The imidized-grafted carboxylic acid ethylene olefin copolymer is finally reacted with an organic anhydride of a monocarboxylic acid;

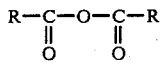

wherein R is 1 to 30 carbon atoms, substituted or unsubstituted, alkyl, cycloalkyl, alkenyl, aryl, or heterocyclic radical; or with the anhydride of a dicarboxylic acid represented by the structure:

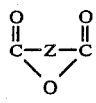

where Z is a 2 to 10 carbon atom alkylene, arylene or alkenylene.

4-Vinyl Pyridine/Alkyl Methacrylate Copolymers

The materials of this group are also known in the art. For instance, U.S. Pat. No. 2,737,452 (which is incorporated by reference) discloses a procedure for the production of alkyl methacrylate/4-vinyl pyridine copolymers.

The copolymers are produced by reacting 4-vinylpyridine with a nitrogen amine free ester of a $C_1$ to $C_{20}$ olefinically unsaturated aliphatic mono-, di- or polycarboxylic acid or mixtures thereof. The reaction conditions are well known.

The preferred copolymer for this use is one produced from vinyl pyridine and lauryl methacrylate.

OTHER ADDITIVES

Other materials, as noted above, may be included in the ultimately used along with the inventive complexes in lubricating or fuel oil compositions. Some of them are discussed below.

DISPERSANT

One dispersant preferred for use in this composition is a long chain hydrocarbyl substituted dicarboxylic acid material, i.e., acid or anhydride, or ester and includes a long chain hydrocarbon, generally a polyolefin, substituted with at least 1.05 of an alpha or beta unsaturated $C_4$ to $C_{10}$ dicarboxylic acid, such as itaconic acid, maleic acid, maleic anhydride, chloromaleic acid, dimethyl fumarate, chloromaleic anhydride, etc., per mole of polyolefin and neutralized with other amines or agents.

Examples of dispersants are contained in above patent literature. Some typical dispersants are disclosed in U.S. Pat. Nos. 3,087,936; 3,254,025; 3,632,511; 3,804,763; 4,102,798; 4,111,876; 4,113,639; as well as in many other patents in this field.

DETERGENTS

Metal-containing rust inhibitors and/or detergents are frequently used with ashless dispersants. Such detergents and rust inhibitors include the metal salts of sulfonic acids, alkyl phenols, sulfurized alkyl phenols, alkyl salicylates, napthenates, and other oil soluble mono- and di-carboxylic acids. Highly basic (or "overbased") metal salts which are frequently used as detergents appear particularly prone to interaction with the ashless dispersant. Usually these metal-containing rust inhibitors and detergents are used in lubricating oil in amounts of about 0.01 to 10, e.g., 0.1 to 5 weight percent, based on the weight of the total lubricating composition.

Various other preparations of basic alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

ANTIWEAR ADDITIVES

Dihydrocarbyl dithiophosphate metal salts are frequently added to lubricating oil compositions as antiwear agents. They also provide antioxidant activity. The zinc salts are most commonly used in lubricating oil in amounts of 0.1 to 10, preferably 0.2 to 2 weight percent, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

ANTIOXIDANTS

A material which has been used as in an antioxidant in lubricating oil compositions containing a zinc dihydrocarbyl dithiophosphate and ashless dispersant is copper, in the form of a synthetic or natural carboxylic acid. Examples include $C_{10}$ to $C_{18}$ fatty acids such as stearic or palmitic acid. But unsaturated acids (such as oleic acid), branched carboxylic acids (such as naphthenic acids) or molecular weight form 200 to 500 and, synthetic carboxylic acids are all used because of the acceptable handling and solubility properties of the resulting copper carboxylates.

Suitable oil soluble dithiocarbamates have the general formula $(RR'NCSS)_n Cu$; where n is 1 or 2 and R and R' may be the same or different hydrocarbly radicals containing from 1 to 18 carbon atoms and including radicals such as alkyl, alkenyl, aryl, aralkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butyl-phenyl, cyclohexyl, methylcyclopentyl, propenyl, butenyl, etc. In order to obtain oil solubility, the total number of carbon atoms (i.e., R and R') generally should be about 5 or greater.

Copper sulfonates, phenates and acetyl acetonates can also be used.

These antioxidants are used in amounts such that, in the final lubricating or fuel composition, a copper concentration of from about 5 to about 500 ppm is present.

This invention will be further understood by reference to the following examples, wherein all parts are parts by weight, unless otherwise noted. The examples are intended only to exemplify the invention and are not to be considered to limit it in any way.

EXAMPLES

Example 1 (Production of zn-PIBSA)

About 1250 g. of a 70% oil solution of a polyisobutenyl succinic anhydride (PIBSA) of Saponification Number (SAP) 69 and derived from a polyisobutylene of average molecular weight of 1300 was dissolved in 2250 g of mineral oil solvent 150 neutral (S 150 N). The oil solution was mixed with 171.4 g of zinc acetate dihydrate, 20 ml of water and heated slowly to 100° C. and soaked at this temperature for two hours. The reaction temperature was then raised to 130° C. and the oil solution was stripped at 130° C. for one hour with a nitrogen gas stream. The product was filtered and collected. The 25% oil solution analyzed for 1.53 weight percent Zn, theory 1.60 weight percent Zn.

Example 2 (Production of Zn-PIBSA)

About 190 g of a polyisobutenyl succinic anhydride of SAP No. 112 and derived from a polyisobutylene of molecular weight average of 940 was mixed with 532 g S 150 N, 4.1 g of zinc acetate dihydrate, 5 ml of water and reacted in the same manner as Example 1. The 25% oil solution analyzed for 1.61 weight percent Zn.

Example 3 (Production of Zn-PIBSA)

About 190 g of a polyisobutenyl succinic anhydride of SAP No. 55 and derived from a polyisobutylene of average molecular weight of 1950 was mixed with 395 g of mineral oil S 150 N. The reaction mixture was combined with 20.7 g of $ZnAC_2.2H_2O$, 5 ml of water and heated to 100° C. according to the method of Example 1. The 25 weight percent oil solution analyzed for 1.04 weight percent Zn.

Example 4 (Production of Zn-PIBSA)

About 190 g of a PIBSA of SAP No. 46.5 and derived from a PIB of average molecular weight of 2250 was dissolved in 381.5 g of mineral oil S150N. The oil solution was then wixed with 17.4 g of $AnAc_2.2H_2O$, 5 ml of water and slowly heated to 100° C. The reaction was then carried out in the same manner as in Example 1. The 25% oil solution analyzed for 0.85 weight percent Zn.

Example 5 (Production of Cu-PIBSA)

About 424 g of the PIBSA of Example 1 was dissolved in 577 g of mineral oil S 150 N and mixed with 52 g of cupric acetate and 10 ml of water. This mixture was heated slowly to 90° C. and soaked at this temperature for 2 hours. The reaction mixture was then heated to 130° C. for a half hour and stripped with nitrogen for one hour. The filtered oil solution was analyzed and contained 1.25 weight percent Cu.

Example 6 (Production of Mg-PIBSA)

About 100 g of a 70% of oil solution of a PIBSA derived from a polyisobutylene of average molecular weight of 1300 was dissolved ion 180 g of mineral oil S150N and mixed with 13.1 g of magnesium acetate tetrahydrate in 20 ml of water. The reaction mixture was then slowly heated to 100° C. Once the reaction temperature reached 100° C., it was soaked at this temperature for two hours, heated to 140° C. and stripped with a nitrogen stream for one hour. The 25% metal salt solution was filtered and collected. It analyzed for 0.55 weight percent Mg, theoretical 0.60 weight percent.

Example 7 (Production of Ca-PIBSA)

About 120 g of the PIBSA of Example 1 was dissolved in 216 g of mineral oil S 150 N and mixed with 12.4 g of $CaAc_2.1/2H_2O$, and 5 ml of water. The reaction mixture was heated slowly to 100° C. and soaked at this temperature for two hours. The temperature of the reaction mixture was raised to 140° C. and stripped with a nitrogen stream for one hour. The 25% oil solution was filtered and collected. It analyzed for 0.85% Ca.

Example 8 (Production of Lauryl Methacrylate/Vinyl Pyridine Copolymer)

The following was charged into a 500 ml resin kettle, which was equipped with a stirrer, nitrogen blanket and thermometer;

200 g lauryl methacrylate
200 g distilled water
1 g azobisisobutyronitrile
4 g sodium lauryl sulfate
7 g 4-vinyl pyridine The polymerization was conducted at about 80° C. for 5 hours. The product mixture was allowed to cool and then filtered slowly overnight. The resultant tough, tacky residue was dried with a hair dryer several hours, then 19 hours under vacuum at 200° F. The final product was clear, very tough, exhibited very low flow and was adhesive. Molecular weight as determined from toluene solution viscosity was about 1,400,000.

Example 9 (Viscosity Measurements)

A sample of the LMVP Example 8 material was dissolved in 100 N oil. The concentration was 5%. Samples of the PIBSA starting material of Example 1 and the Zn-PIBSA of Example 1 were also separately dissolved in the 100 N oil to a 5% level. Mixtures of 1MVP/PIBSA and LMVP/Zn-PIBSA were also produced. The viscosities of each were measured (Brookfield viscometer, at 25° C.) and are shown in the Table.

TABLE

| Sample | Viscosity (cP) |
|---|---|
| 5% LMVP in Oil | 180 |
| 5% PIBSA in Oil | 47 |
| 5% Zn—PIBSA in Oil | 65 |
| 5% PIBSA + 5% LMVP in Oil | 320 |
| 5% Zn—PIBSA + 5% LMVP in Oil | 13,900 |

The data clearly showed that none of the single components have high viscosity and that PIBSA itself is not responsible (in combination with LMVP) for the exceptional viscosity increase demonstrated by the Zn-PIBSA/LMVP combination.

Example 10 (Viscosity Measurements)

Additional blends of LMVP and PIBSA or PIBSA salts were prepared using the PIBSA starting material of Example 1, and the products of Examples 1, 6, and 8. The viscosities of the individual components and the mixtures with LMVP were measured on a Brookfield Viscometer at 25° C. The results were:

| SAMPLE | RPM | VISCOSITY, cP |
|---|---|---|
| 5% LMVP | 6 | 182.5 |
| 5% Zn—PIBSA | 6 | 64.5 |
| 5% Mg—PIBSA | 6 | 95 |
| 5% Ca—PIBSA | 6 | 66 |
| 5% LMVP + 5% PIBSA | 6 | 311 |
| 5% LMVP + 5% Zn—PIBSA | 6 | 21,145 |
| 5% LMVP + 5% Mg—PIBSA | 3 | 671 |
| 5% LMVP + 5% Ca—PIBSA | 6 | 258 |

Again the Zn salt produces exceptional viscosification as compared with the other salts.

Example 11 (Viscosity of mixtures at various concentrations)

Mixtures of Zn-PIBSA, Mg-PIBSA, and Ca-PIBSA with LMVP in 100N oil at various total additive concentration and LMVP/PIBSA salt ratios were produced. The viscosities of each were measured. The data are shown below. The term "total additive concentration" represents the weight percent additive.

| | Zn—PIBSA | |
|---|---|---|
| TOTAL ADDITIVE CONCENTRATION | LMVP/Zn—PIBSA RATIO | VISCOSITY, cP (25° C.) |
| 10 | 2/1 | 7,090 |
| 10 | 1/1 | 14,000–21,000 |
| 10 | 1/2 | 1,908 |
| 5 | 2/1 | 260 |
| 5 | 1/1 | 193 |
| 5 | 1/2 | 195 |
| 2 | 2/1 | 75 |
| 2 | 1/1 | 64 |
| 2 | 1/2 | 67 |
| 1 | 2/1 | 49 |
| 1 | 1/1 | 47 |
| 1 | 1/2 | 46 |

| | Mg—PIBSA | |
|---|---|---|
| TOTAL ADDITIVE CONCENTRATION | LMVP/Mg—PIBSA RATIO | VISCOSITY, cP (25° C.) |
| 10 | 2/1 | 742 |
| 10 | 1/1 | 671 |
| 10 | 1/2 | 826 |
| 5 | 2/1 | 175 |
| 5 | 1/1 | 172 |
| 5 | 1/2 | 154 |
| 2 | 2/1 | 67 |
| 2 | 1/1 | 64 |
| 2 | 1/2 | 57 |
| 1 | 2/1 | 48 |
| 1 | 1/1 | 47 |
| 1 | 1/2 | 44 |

| | Ca—PIBSA | |
|---|---|---|
| TOTAL ADDITIVE CONCENTRATION | LMVP/Ca—PIBSA RATIO | VISCOSITY, cP (25° C.) |
| 10 | 2/1 | 344 |
| 10 | 1/1 | 258 |
| 10 | 1/2 | 215 |
| 5 | 2/1 | 128 |
| 5 | 1/1 | 111 |
| 5 | 1/2 | 90 |
| 2 | 2/1 | 62 |
| 2 | 1/1 | 58 |
| 2 | 1/2 | 51 |
| 1 | 2/1 | 46 |
| 1 | 1/1 | 46 |
| 1 | 1/2 | 43 |

Example 12 (Viscosity of Cu-PIBSA/LMVP Mixtures)

A sample of the Example 5 Cu-PIBSA was blended with the Example 8 LMVP material at a ratio of 1/1. The viscosity measurement data at various total additive concentrations are shown in the table below.

Cu-PIBSA salts are clearly even more effective than are Zn salts in providing viscosification of a neutral mineral oil and the Zn-PIBSA salts provided 10 to 50 times higher viscosification than did the Ca or Mg salts.

| | Cu—PIBSA | |
|---|---|---|
| TOTAL ADDITIVE CONCENTRATION | LMVP/Cu—PIBSA RATIO | VISCOSITY, cP (25° C.) |
| 4 | 1/1 | 10,800 |
| 3 | 1/1 | 1,065 |
| 2 | 1/1 | 297 |
| 1 | 1/1 | 103 |
| 0.5 | 1/1 | 57 |

Having thus described the invention by direct disclosures and by examples, it should be apparent to one having ordinary skill in the art that there exists various equivalents to the materials specifically disclosed that would be within the spirit of the invention as claimed hereafter.

We claim as our invention:

1. A composition comprising:

a transition metal or group IIB metal salt of a hydrocarbyl substituted $C_4$ to $C_{10}$ monounsaturated dicarboxylic acid producing reaction product, which reaction product is formed by reacting olefin polymer of $C_2$ to $C_{10}$ mono-olefin having a number average molecular weight greater than about 900 and a $C_4$ to $C_{10}$ monounsaturated acid material, and a second material selected from:

(a) an ethylene-olefin copolymer which has been grafted with a polyolefinic dicarboxylic acid and reacted with a polyamine and a carboxylic acid, or (b) a copolymer of 4-vinyl pyridine and a nitrogen-amine-free ester of a $C_1$–$C_{20}$ olefinically unsaturated aliphatic mono-, di-, or polycarboxylic acid.

2. The composition of claim 1 wherein the transition metal is selected from Group IB or IIB.

3. The composition of claim 2 wherein the metal salt is a zinc or copper salt.

4. The composition of claim 3 wherein the metal salt is a copper salt.

5. The composition of claim 3 wherein the metal salt is a zinc salt.

6. The composition of claim 1 wherein the $C_4$ to $C_{10}$ monounsaturated acid material used to prepare the metal salt is maleic anhydride.

7. The composition of claim 6 wherein the olefin polymer used to produce the metal salt is a polybutene.

8. The composition of claim 6 wherein the olefin polymer used to produce the metal salt is polyisobutylene.

9. The composition of claim 3 wherein the monounsaturated acid material used to produce the metal salt is maleic anhydride.

10. The composition of claim 3 wherein the olefin polymer used to produce the metal salt is polyisobutylene.

11. The composition of claim 3 wherein the second material comprises a ethylene-olefin copolymer of 2–98% ethylene and 2–98% $C_3$–$C_{28}$ alpha-olefins.

12. The composition of claim 11 wherein the alpha-olefin is propylene.

13. The composition of claim 3 wherein the ethylene-olefin copolymer comprises an ethylene-propylene backbone grafted with a material of the formula:

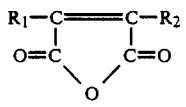

wherein $R_1$ and $R_2$ are independently a hydrogen or a halogen.

14. The composition of claim 13 wherein the ethylene-propylene is grafted with maleic acid or maleic anhydride.

15. The composition of claim 3 wherein the second material comprises a copolymer of 4-pyridine and lauryl methacrylate.

16. A composition comprising:

(a) at least a minor amount of a hydrocarbon, and (b) a transition metal or Group IIB metal salt of a hydrocarbyl substituted $C_4$ to $C_{10}$ monounsaturated dicarboxylic acid producing reaction product, which reaction product is formed by reacting olefin polymer of $C_2$ to $C_{10}$ mono-olefin having a number average molecular weight greater than about 900 and a $C_4$ to $C_{10}$ monounsaturated acid material, and (c) a second material selected from:

(i) an ethylene-olefin copolymer which has been grafted with a polyolefinic dicarboxylic acid and reacted with a polyamine and a carboxylic acid, or (ii) a copolymer of 4-vinyl pyridine and a nitrogen-amine-free ester of a $C_1$ to $C_{20}$ olefinically unsaturated aliphatic mono-, di-, or polycarboxylic acid.

17. The composition of claim 16 wherein the metal is selected from Group IB or IIB.

18. The composition of claim 17 wherein the metal salt is a zinc or copper salt.

19. The composition of claim 18 wherein the metal salt is a copper salt.

20. The composition of claim 18 wherein the metal salt is a zinc salt.

21. The composition of claim 18 wherein the hydrocarbon is a lubricating oil.

22. The composition of claim 21 wherein the lubricating oil is a mineral oil.

23. The composition of claim 21 wherein the hydrocarbon is a linear paraffinic compound or mixture of compounds containing from 5 to 25 carbon atoms and having a viscosity, at 25° C., of from about 1 to about 400 centipoise.

24. The composition of claim 21 wherein the hydrocarbon or aromatic hydrocarbon or mixture of hydrocarbons having a viscosity, at 25° C., of from about 1 to about 400 centipoise.

25. The composition of claim 21 wherein the $C_4$ to $C_{10}$ monounsaturated acid material used to prepare the metal salt is maleic anhydride.

26. The composition of claim 25 wherein the olefin polymer used to produce the metal salt is a polybutene.

27. The composition of claim 25 wherein the olefin polymer used to produce the metal salt is a polybutene.

28. The composition of claim 21 wherein the monounsaturated acid material used to produce the metal salt is maleic anhydride.

29. The composition of claim 21 wherein the olefin polymer used to produce the metal salt is polyisobutylene.

30. The composition of claim 21 wherein the second material comprises a ethylene-olefin copolymer of 2–98% ethylene and 2–98% $C_3$–$C_{28}$ alpha-olefins.

31. The composition of claim 30 wherein the alpha-olefin is propylene.

32. The composition of claim 21 wherein the ethylene-olefin copolymer comprises an ethylene-propylene backbone grafted with a material of the formula:

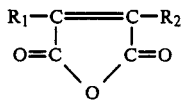

wherein $R_1$ and $R_2$ are independently a hydrogen or a halogen.

33. The composition of claim 32 wherein the ethylene-propylene is grafted with maleic acid or maleic anhydride.

34. The composition of claim 21 wherein the second material comprises a copolymer of 4-pyridine and lauryl methacrylate.

* * * * *